United States Patent [19]

Schulz

[11] 4,239,613

[45] Dec. 16, 1980

[54] DEASHED COAL FROM NITRIC ACID OXIDATION OF AQUEOUS COAL SLURRY

[75] Inventor: Johann G. Schulz, Pittsburgh, Pa.

[73] Assignee: Gulf Research & Development Company, Pittsburgh, Pa.

[21] Appl. No.: 46,441

[22] Filed: Jun. 7, 1979

[51] Int. Cl.[3] ..... C10G 1/00

[52] U.S. Cl. ..... 208/8 LE; 208/8 R

[58] Field of Search ..... 208/8 E, 8 R

[56] References Cited

U.S. PATENT DOCUMENTS

| | | | |
|---|---|---|---|
| 221,410 | 11/1940 | Pier | 208/8 LE |
| 2,242,822 | 5/1941 | Fuchs | 208/8 LE |

*Primary Examiner*—Veronica O'Keefe

[57] ABSTRACT

Novel deashed coal obtained by oxidizing coal with aqueous nitric acid, separating from the resulting product an aqueous phase and a solid phase, extracting the solid phase with a solvent and then heating the extract to remove volatile material therefrom.

13 Claims, No Drawings

DEASHED COAL FROM NITRIC ACID OXIDATION OF AQUEOUS COAL SLURRY

BACKGROUND OF THE INVENTION

1. Field of the Invention

This invention relates to a novel deashed coal obtained by oxidizing coal with aqueous nitric acid, separating from the resulting product an aqueous phase and a solid phase, extracting the solid phase with a solvent and then heating the extract to remove volatile material therefrom.

2. Description of the Prior Art

Ash (inorganic components which will not burn when coal is subjected to combustion) can be removed from coal by heating a coal slurry with hydrogen at elevated temperatures and elevated pressures for a time sufficient to liquefy the coal and then subjecting the hydrogenated product to filtration to remove the solids (ash) therefrom. Although the process is effective for its intended purpose the cost of such removal is high because of the large amounts of hydrogen consumed and because of the high temperatures and high pressures required. It would be highly desirable, therefore, to find an alternative process for deashing coal.

SUMMARY OF THE INVENTION

I have found that a novel deashed coal can be obtained by oxidizing coal with aqueous nitric acid, separating from the resulting product an aqueous phase and a solid phase, extracting the solid phase with a solvent and then heating the extract to remove volatile material therefrom.

Raw coal that can be used to prepare the novel deashed coal defined and claimed herein can have the following composition, on a moisture-free basis:

TABLE I

| | Weight Percent | |
|---|---|---|
| | Broad Range | General Range |
| Carbon | 45–95 | 60–92 |
| Hydrogen | 2.5–7 | 4–6 |
| Oxygen | 2–45 | 3–25 |
| Nitrogen | 0.75–2.5 | 0.75–2.5 |
| Sulfur | 0.3–10 | 0.5–6 |

The carbon and hydrogen content of the coal is believed to reside primarily in multi-ring aromatic compounds (condensed and/or uncondensed) heterocyclic compounds, etc. Oxygen and nitrogen are believed to be present primarily in chemical combination, while some of the sulfur is believed to be present in chemical combination with the aromatic compounds and some in chemical combination with inorganic elements associated therewith, for example, iron and calcium.

In addition to the above the coal will also contain solid, primarily inorganic compounds which will not burn, termed "ash", and which are believed to be composed chiefly of compounds of silicon, aluminum, iron and calcium, with smaller amounts of magnesium, titanium, sodium and potassium. The ash content of the coal treated herein will amount to less than about 50 weight percent, based on the moisture-free coal, but, in general, will amount to about 0.1 to about 30 weight percent, usually about 0.5 to about 20 weight percent.

Anthracitic, bituminous and subbituminous coal, lignitic materials, and other type of coal products referred to in ASTM D-388 are exemplary of the coals which can be deashed herein. Some of the coals in their raw state will contain relatively large amounts of water. These can be dried prior to use herein if desired. The coal, prior to use, is preferably ground in a suitable manner, for example, in a hammermill, to size such that at least about 50 percent of the coal will pass through a 40-mesh (U.S. Series) sieve.

The first step in the process involves subjecting the coal to oxidation with aqueous nitric acid. Thus, an aqueous coal slurry, containing from about 40 to about 95 weight percent water, preferably about 50 to about 70 weight percent water, is brought in contact with aqueous nitric acid having a concentration of about five to about 90 percent, preferably about 10 to about 70 percent. What is important is that the resultant mixture contains coal and nitric acid (as 100 percent nitric acid) in a weight ratio of about 1:0.1 to about 1:10, preferably about 1:0.3 to about 1:5.

The resultant mixture is stirred while maintaining the same at a temperature of about 5° to about 200° C., preferably about 50° to about 100° C. and a pressure of about atmospheric (ambient) to about 1000 pounds per square inch gauge (68 kPa), preferably about atmospheric to about 500 pounds per square inch gauge (34 kPa), for about 0.5 to about 15 hours, preferably about two to about six hours. Gaseous nitrogen oxides that may be formed can be removed from the reaction zone as they are formed. If desired in order to reduce the consumption of nitric acid, the process can be carried out in the additional presence of molecular oxygen wherein the partial pressure of the molecular oxygen can be in the range of about atmospheric to about 1500 pounds per square inch gauge (100 kPa), preferably about atmospheric to about 750 pounds per square inch gauge (50 kPa).

The resulting slurry is then treated to separate the aqueous phase from the solids therein. This can be done mechanically, for example, using a centrifuge or a filter. The filtrate or aqueous phase, containing water, nitric acid, sulfuric acid, some of the ash that was present in the coal charge and other oxidation products, is discarded, while the recovered solids are subjected to extraction using one or a combination of solvents. Although relatively common organic polar solvents, such as acetone, methylketone, cyclohexanone, methanol, ethanol, isopropanol, tetrahydrofuran, dioxane, can be used, combination of solvents, for example, a mixture containing a ketone, such as acetone, methylethylketone or cyclohexanone and an alcohol, such as methanol, ethanol or isopropanol, a mixture containing a ketone, such as methylethylketone, methylisobutylketone or cyclohexanone and water, a mixture containing a ketonic alcohol, such as acetol, diacetone alcohol, 4-hydroxy-2-butanone, 3-hydroxy-2-butanone or 4-hydroxy-2-pentanone and an ether alcohol, such as tetrahydrofurfuryl alcohol or 2-hydroxymethyltetrahydropyran can also be used. In fact any solvent can be used in such extraction that will dissolve carbonaceous material in said solids but not the ash content thereof. The conditions of extraction are not critical and can be carried out over a wide range, for example, at a temperature of about 20° to about 200° C., preferably about 25° to about 50° C. and a pressure of about atmospheric to about 500 pounds per square inch (34 kPa), preferably about atmospheric to about 100 pounds per square inch gauge (7 kPa). The solid material left behind is believed to be composed essentially of ash.

The solvent can be removed from the extract in any convenient manner, for example by heating at a temperature of about 10° to about 200° C., preferably about 25° to about 100° C., and a pressure of about 10 millimeters of mercury to about atmospheric, preferably about 100 millimeters of mercury to about atmospheric.

Upon removal of the solvent from the extract a solid product composed of substantially water-insoluble polycyclic, polycarboxylic acids, substantially ash- and sulfur-free, is obtained. A procedure that can be used to obtain the above-defined material is exemplified in U.S. Pat. No. 4,052,448 to Schulz et al. In order to obtain the novel substantially ash-free coal herein the solid product is heated to remove volatile material therefrom. This can be done, for example, by heating the same, while stirring, at a temperature of about 100° to about 500° C., preferably about 150° to about 300° C., and a pressure of about 10 millimeters of mercury to about atmospheric, preferably about 100 millimeters of mercury to about atmospheric for about 0.1 to about 10 hours, preferably about one to about five hours. In order to inhibit oxidation of the solids during heating, such heating can be carried out in an inert atmospheric, for example, in a nitrogen atmosphere. During such heating decarboxylation takes place and, therefore, temperatures employed should be sufficiently high to convert intermediate dehydration products to the desired deashed coal. Analysis of the gases obtained shows them to be essentially carbon dioxide and nitrogen. The resulting substantially oxygen-free product is the novel deashed coal claimed herein.

DESCRIPTION OF PREFERRED EMBODIMENTS

EXAMPLE I

In this Example a raw Belle Ayr coal having a heat value of 10,154 BTU/pound (5640 calories/gram) and analyzing as follows, in weight percent on a dry basis, was used: 72.17 percent carbon, 4.74 percent hydrogen, one percent nitrogen, 13.85 percent oxygen, 0.56 percent sulfur, and 7.71 weight percent ash. Into an open one-gallon (3850 cc) glass vessel, equipped with a stirrer, thermometer and heating and cooling coils were introduced 320 cc of water and 100 cc of 70 percent aqueous nitric acid. While the contents were stirred, they were brought to 80° C. Over a period of 1.75 hours there was gradually added to the vessel 800 grams (648 grams on a dry basis) of the above coal in powdered form. Over the same 1.75 hours there was also added a mixture containing 302 cc of water and 298 cc of 70 percent aqueous nitric acid. Over an additional period of 0.15 hour there was added a mixture containing 18 cc of water and 17 cc of 70 percent aqueous nitric acid. The contents of the vessel were then held at 80° C. for 45 minutes. Addition was resumed, lasting for 1.85 hours, of a mixture containing 320 cc of water and 315 cc of 70 percent aqueous nitric acid. The contents of the reactor were then held at 80° C. for one hour, after which they were cooled to room temperature and filtered. The solids obtained were extracted at 87° C. with a two-liter mixture containing 90 weight percent methylethylketone and 10 weight percent water. After removing the solvent from the extract by heating at a temperature of 50° C. there was recovered 512.7 grams of solids whose ash content was nil and whose sulfur content was 0.3 weight percent. The heating value of this product was 8673 BTU/pound (4818 calories/gram). the insoluble residue obtained, amounting to 88.2 grams consisted essentially of ash and of insoluble carbon. 2.4 grams of the extract to obtained was then placed in a flask connected to a gas collecting bottle and heated gently over a period of one hour and atmospheric pressure from room temperature to 200° C. Gas evolution, totaling 272 milliliters of carbon dioxide, started at 75° C. and continued until the final temperature was reached. 1.6 grams of product was recovered, essentially ash-free, having a heating value of 11,430 BTU/pound (6350 calories/gram). Each of the heating values obtained herein was obtained following the procedure in ASTM D-240.

The above results are surprising. It should be noted that the raw coal had a heating value of 10,154 BTU/pound, while the extract obtained from the oxidized coal had a heating value of 8,673 BTU/pound. However, when the latter was subjected to heat to remove volatiles therefrom, the heating value of the coal was increased by about 32 percent to 11,430 BTU/pound, a higher value than the original coal. In addition, the coal was essentially free of ash and of sulfur.

EXAMPLE II

In this Example a raw Kentucky No. 9 coal having a heat value of 11,874 BTU/pound (6596 calories/gram) and analyzing as follows, in weight percent on a dry basis, as used: 68.69 percent carbon, 4.88 percent hydrogen, 1.52 percent nitrogen, 13.17 percent oxygen, 4.39 percent sulfur and 10.9 percent ash. Into an open one-gallon (3850 cc) glass vessel, equipped with a stirrer, thermometer and heating and cooling coils were introduced 320 cc of water and 100 cc of 70 percent aqueous nitric acid. While the contents were stirred, they were brought to 80° C. Over a period of 1.75 hours there was gradually added to the vessel 800 grams (791 grams on a dry basis) of the above coal in powdered form. Over the same 1.75 hours there was also added a mixture containing 280 cc of water and 348 cc of 70 percent aqueous nitric acid. Over an additional period of 0.25 hour there was added a mixture containing 40 cc of water and 50 cc of 70 percent aqueous nitric acid. The contents of the vessel were then held at 80° C. for one hour. Addition was resumed, lasting for two hours, of a mixture containing 320 cc of water and 395 cc of 70 percent aqueous nitric acid. The contents of the reactor were held at 80° C. for one hour, after which they were cooled to room temperature and filtered. The solids obtained were extracted at 87° C. with a two-liter mixture containing 90 weight percent methylethylketone and 10 weight percent water. After removing the solvent from the extract by heating at a temperature of 50° C. there was recovered 359 grams of solids whose ash content was nil and whose sulfur content was 1.48 percent. The heating value of this product was 9920 BTU/pound (5511 calories/gram). The insoluble residue obtained, amounting to 500 grams, consisted essentially of ash and insoluble carbon. Three grams of the extract so obtained was then placed in a flask connected to a gas collecting bottle and heated gently over a period of one hour and atmospheric pressure from room temperature to 200° C. Gas evolution, totaling 233 milliliters of carbon dioxide, started at 75° C. and contained until the final temperature was reached. 1.9 grams of product was recovered, essentially ash-free, having a heating value of 12056 BTU/pound (6698 calories/gram).

Obviously, many modifications and variations of the invention, as hereinabove set forth, can be made without departing from the spirit and scope thereof and, therefore, only such limitations should be imposed as are indicated in the appended claims.

We claim:

1. Novel deashed coal obtained by oxidizing an aqueous coal slurry containing from about 40 to about 95 weight percent water with aqueous nitric acid, separating from the resulting product an aqueous phase and a solid phase, extracting the solid phase with a solvent, removing the solvent from the extract, and then heating the extract at a temperature of about 100° to about 500° C. and a pressure of about 10 millimeters of mercury to about atmospheric pressure in an inert atmosphere to remove volatile material therefrom.

2. The deashed coal of claim 1 wherein the coal being oxidized is in an aqueous slurry containing from about 50 to about 70 weight percent water.

3. The deashed coal of claim 1 wherein the nitric acid has a concentration of about five to about 90 percent.

4. The deashed coal of claim 1 wherein the nitric acid has a concentration of about 10 to about 70 percent.

5. The deashed coal of claim 1 wherein the oxidation is carried out at a temperature of about 5° to about 200° C. and a pressure of about atmospheric to about 1000 pounds per square inch gauge over a period of about 0.5 to about 15 hours.

6. The deashed coal of claim 1 wherein the oxidation is carried out at a temperature of about 50° to about 100° C. and a pressure of about atmospheric to about 500 pounds per square inch gauge over a period of about two to about six hours.

7. The deashed coal of claim 1 wherein said separation is effected by filtration.

8. The deashed coal of claim 1 wherein said extraction is carried out using a solvent that will dissolve carbonaceous materials in said solid phase.

9. The deashed coal of claim 1 wherein said extraction is carried out using a polar solvent.

10. The deashed coal of claim 1 wherein said extraction is carried out using at least one solvent selected from the group consisting of acetone, methylethylketone, cyclohexanone, methanol, ethanol, normal propanol, isopropanol, tetrahydrofuran, dioxane, acetol, diacetone alcohol, 4-hydroxy-2-butanone, 3-hydroxy-2-butanone, 4-hydroxy-2-pentanone, tetrahydrofuryl alcohol and 2-hydroxymethyltetrahydropyran.

11. The deashed coal of claim 1 wherein said extraction is carried out using methylethylketone.

12. The deashed coal of claim 1 wherein said extract is heated at a temperature of about 150° to about 300° C. and a pressure of about 100 millimeters of mercury to about atmospheric pressure.

13. The deashed coal of claim 1 wherein upon said heating of said extract decarboxylation of said extract occurs, with said volatile material being composed of carbon dioxide and nitrogen.

* * * * *